US006408495B2

(12) United States Patent
Ida

(10) Patent No.: US 6,408,495 B2
(45) Date of Patent: Jun. 25, 2002

(54) HOOK FOR CLOTHES

(75) Inventor: Kazuo Ida, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/790,669

(22) Filed: Feb. 23, 2001

(30) Foreign Application Priority Data

Feb. 29, 2000 (JP) ..... 2000-053959

(51) Int. Cl.[7] ..... A44B 13/00

(52) U.S. Cl. ..... 24/702; 24/477; 24/698.2; 24/695; 24/DIG. 41; 2/219

(58) Field of Search ..... 24/702, 190, 194, 24/477, 662, 693, 623, 691, 689, 695, 652, 698.1, 698.2, 698.3, 584.1, 589.1, 590.1, 682.1, 578.1, 579.09, 580.11, 323, DIG. 41; 2/265, 219, 312, 235, 218.2

(56) References Cited

U.S. PATENT DOCUMENTS 206,883 A * 8/1878 Kittson
1,404,471 A * 1/1922 Nilsson
1,428,358 A * 9/1922 Burbery
2,028,020 A * 1/1936 Sheldon
2,105,213 A * 1/1938 Clark
2,703,915 A * 3/1955 Markin
2,731,694 A * 1/1956 Steinmetz
3,445,901 A * 5/1969 Kamper
4,253,226 A * 3/1981 Takeda ..... 29/432.1
5,467,509 A * 11/1995 Fukushima ..... 24/689

* cited by examiner

*Primary Examiner*—Robert J. Sandy
(74) *Attorney, Agent, or Firm*—Finnegan, Henderson, Farabow, Garrett & Dunner, LLP

(57) ABSTRACT

A hook for clothes, wherein a male member is unlikely to escape from a female member when the male member engages with the female member and which can be attached on clothes easily by means of an automatic machine. More specifically, a hook for clothes comprising a female member, a male member and an attaching member, wherein the female member has an upheaved swollen portion at an end of its base plate; attaching holes in the upheaved portion; hook-shaped engaging pieces near the upheaved portion; the male member has a concave portion on a side face of its base plate allowing the engaging pieces to fix with play; an engaging protruded portion which engages the engaging piece provided at a rear end of the concave portion; attaching holes in the center of the base plate; the attaching member has attaching posts capable of being inserted into the attaching holes of the female and male members, provided on a face of its flat seat plate such that they are posted. The female and male members can be attached onto cloth by an automatic machine. When the male member is inserted into the female member and engaged therewith, the male member is prevented from escaping from the female member by the upheaved portion.

7 Claims, 16 Drawing Sheets

〈PRIOR ART〉

<PRIOR ART>

HOOK FOR CLOTHES

BACKGROUND OF THE INVENTION

1. Field of the Invention

The present invention relates to a hook for clothes which attached on an overlapping portion of waist in trousers, skirt and the like, that is, a waist belt sewed in the form of a bag such that it can be engaged or disengaged freely.

2. Description of the Related Art

According to Japanese Utility Model Publication No. 3-57125, as shown in FIG. 25, a conventional hook for clothes made of synthetic resin is comprised of a female member 1' and a male member 2'. In the female member 1', an attaching hole 7' with a step portion is provided in the center of a rectangular base plate 5' and fitting grooves 31' having protruded walls 30', opposing each other, are formed on both sides of the attaching hole 7'. In the male member 2', a protruded plate 33' having an edge portion capable of engaging with the fitting grooves when inserted is provided, an attaching hole 14' with a step portion is provided in the center of the protruded plate 33' and a contact portion 32' having the same width as the said base plate 5' is provided at an end of the protruded plate 33' so as to restrict an insertion of the male member 2'. And an attaching leg portion is provided in the center of each seat plate, so that the female and male members can be fixed to cloth by crimping.

Further, according to Japanese Patent Application Laid-Open No. 2000-41710, as shown in FIG. 26, another conventional hook for clothes is disclosed, wherein a hook-like engaging piece 8" having a predetermined width is provided on each of both ends of a flat base plate 5" of a female member 1" such that they oppose each other. A concave portion 12" is formed on each side face of a male member 2" so that this concave portion 12" can be fitted in the engaging piece 8" with play. Then, the male member is inserted into the female member in parallel.

In case of the hook for clothes shown in FIG. 25, when the female member 1' and the male member 2' engage with each other, a contact point, that is, a matching face between the protruded walls 30' of the female member 1' and the contact portion 32' of the male member 2' exists at an interval toward a rear end with respect to an attaching leg for attaching the female member 1' to cloth, namely, attaching center. Therefore, if the cloth on which the male member 2' is attached is pulled in an engagement state of the female member 1' and male member 2', consequently the female and male members 1', 2' in the engagement state may be rotated easily. As a result, the female and male members 1', 2' swell the cloth at the attaching position and wrinkles occur on the cloth, thereby providing the clothes with a bad appearance.

Further, when inserting the protruded plate 33' of the male member 2' into the protruded walls 30' of the female member 1', the protruded plate 33' has to be kept in parallel and firmly contact with the protruded walls 30'. Thus, there is no room for play in the inserting operation and that operation is troublesome. Further, because there is no mechanism for preventing the protruded plate 33' of the male member 2' from escaping from the protruded walls 30' of the female member 1' easily when the female and male members 1', 2' engage with each other, the engagement state is unstable.

In case of the hook for cloth shown in FIG. 26, the concave portion 12" provided in the male member 2" is inserted into the hook-shaped engaging pieces 8" provided on the base plate 5" of the female member in parallel and firmly contact with the base plate 5". Thus, the inserting operation is troublesome. Additionally, because the base plate 5" has no mechanism for preventing the male member 2" from escaping from the female member 1" after insertion and the base plate 5" is flat, the male member 2" is likely to escape easily. Further, because the female member 1" has the attaching post 19" on its back face, when attaching the female member 1" on the bag-like waist belt provided with a slight inner space because surrounded by cloth, first, the seat plate 18" is put into the bag-like waist belt and next, the attaching post 19" is thrust into the cloth and inserted into the attaching hole in the base plate 5". After that, a tip of the attaching post 19" has to be crushed. For this purpose, it is necessary to dispose a punch together with the seat plate 18" in the tube-like waist belt. However, it is very difficult to dispose the punch for crushing the attaching post 19" in such a small space in the bag-like waist belt.

SUMMARY OF THE INVENTION

Accordingly, the invention has been achieved in views of the above described problems. An object of the present invention is to provide a hook for clothes having a mechanism for preventing a male member from escaping from a female member when the male member engages with the female member, so that a stabilized engagement state can be maintained securely. Further, this hook can be attached easily on a waist belt sewed together in the form of tube in clothes by means of an automatic machine and a good appearance without wrinkles is provided.

Another object of the invention is to provide a female member of a hook for clothes, which can be fixed on the waist belt firmly in a stabilized state and can be operated smoothly during use.

And another object of the invention is to provide a female member of a hook for clothes, wherein the female member and the male member maintain a secure engagement state without swinging when the male member is inserted into the female member attached on the waist belt portion, so that the male member is held horizontally in a stabilized state with respect to the female member.

Also another object of the invention is to provide a female member of a hook for clothes which allows the male member to be inserted into the female member attached on the waist belt smoothly and engaging/disengaging operation to be carried out easily with room.

Further object of the invention is to provide a male member of a hook for clothes which can be fixed to the waist belt firmly in a stabilized state and can be operated smoothly during use.

To achieve the above object, according to the main aspect of the invention, there is provided a hook for clothes, comprised of a female member, a male member and an attaching member. The female member has an upheaved portion, which is upheaved toward the surface, at an end of a flat base plate. Attaching holes are made in this upheaved portion for the female member to be attached onto cloth C. Hook-shaped engaging pieces are provided on both sides of the base plate such that they are protruded opposing each other in inward direction.

On the other hand, the male member is formed of a base plate. A concave portion is provided in each side face thereof so that the engaging pieces of the female member can fit with play. Then, an engaging protruded portion is provided laterally at a rear end of this concave portion to engage the engaging pieces thereby stopping a sliding. Attaching holes for attaching the male member onto cloth C are provided in a thick portion in of the base plate. The attaching member has attaching posts which can be inserted into the attaching holes of the female member and the male member, the attaching posts being posted on a flat seat plate.

Preferably, two attaching holes each having a recess, in which its front surface side is expanded, are formed in the upheaved portion of the female member. These attaching holes have substantially the same shape as the attaching holes in the male member and are disposed laterally in the upheaved portion.

Alternatively, one attaching hole having a recess, in which its front side is expanded and having substantially the same shape as the attaching hole in the male member, is disposed in the center of the upheaved portion of the female member. Plural small protrusions, which bite into cloth, are disposed around the attaching hole on a back face of the base plate.

Preferably, a horizontal flat portion is formed between inside ends of the engaging pieces and an end of the upheaved portion disposed on the base plate of the female member, so that the male member is capable of being placed thereon horizontally.

And preferably, a slope in which the male member can be inserted in an inclined sate is formed on the base plate of the female member such that it is entirely inclined gently from the flat portion to a leading end of the base plate.

Further preferably, two attaching holes each having a recess, in which faces thereof opposing the female member are expanded and having substantially the same shape as the attaching hole in the female member, are disposed along the center line of the base plate in a thick portion of the male member.

Alternatively, one attaching hole having a recess, in which a face thereof opposing the female member is expanded and having substantially the same shape as the attaching hole in the female member, is disposed in the center of the base plate, in its thick portion of the male member. Plural small protrusions, which bite into the cloth, are provided around the attaching hole on a back face of the base plate.

DESCRIPTION OF THE PREFERRED EMBODIMENTS

Hereinafter, the preferred embodiments of the hook for clothes of the invention will be described in detail with reference to the accompanying drawings.

Figure 1:
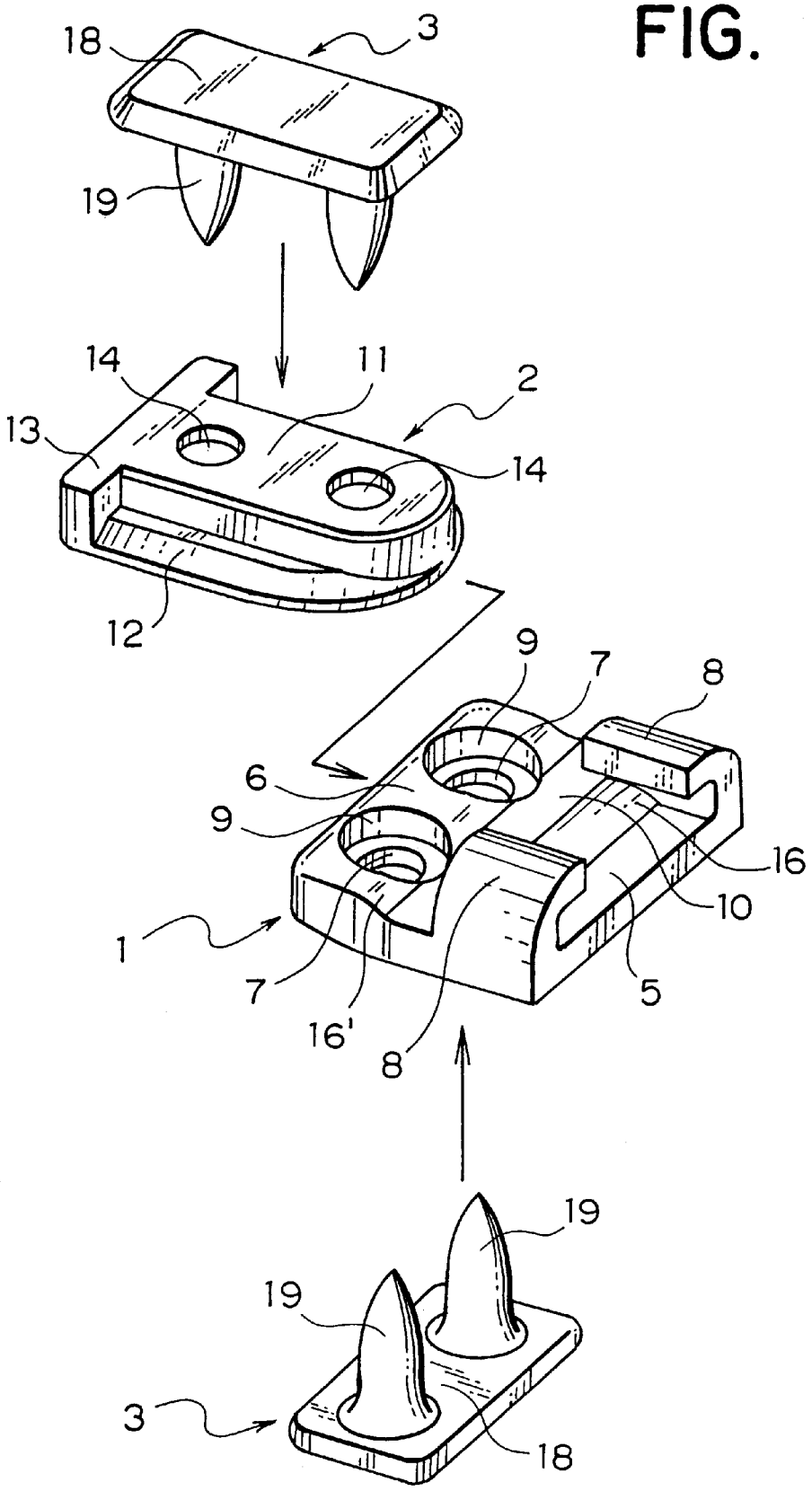
FIG. 1 is a taken-apart perspective view of a hook for clothes according to a first embodiment of the invention.
Figure 14:
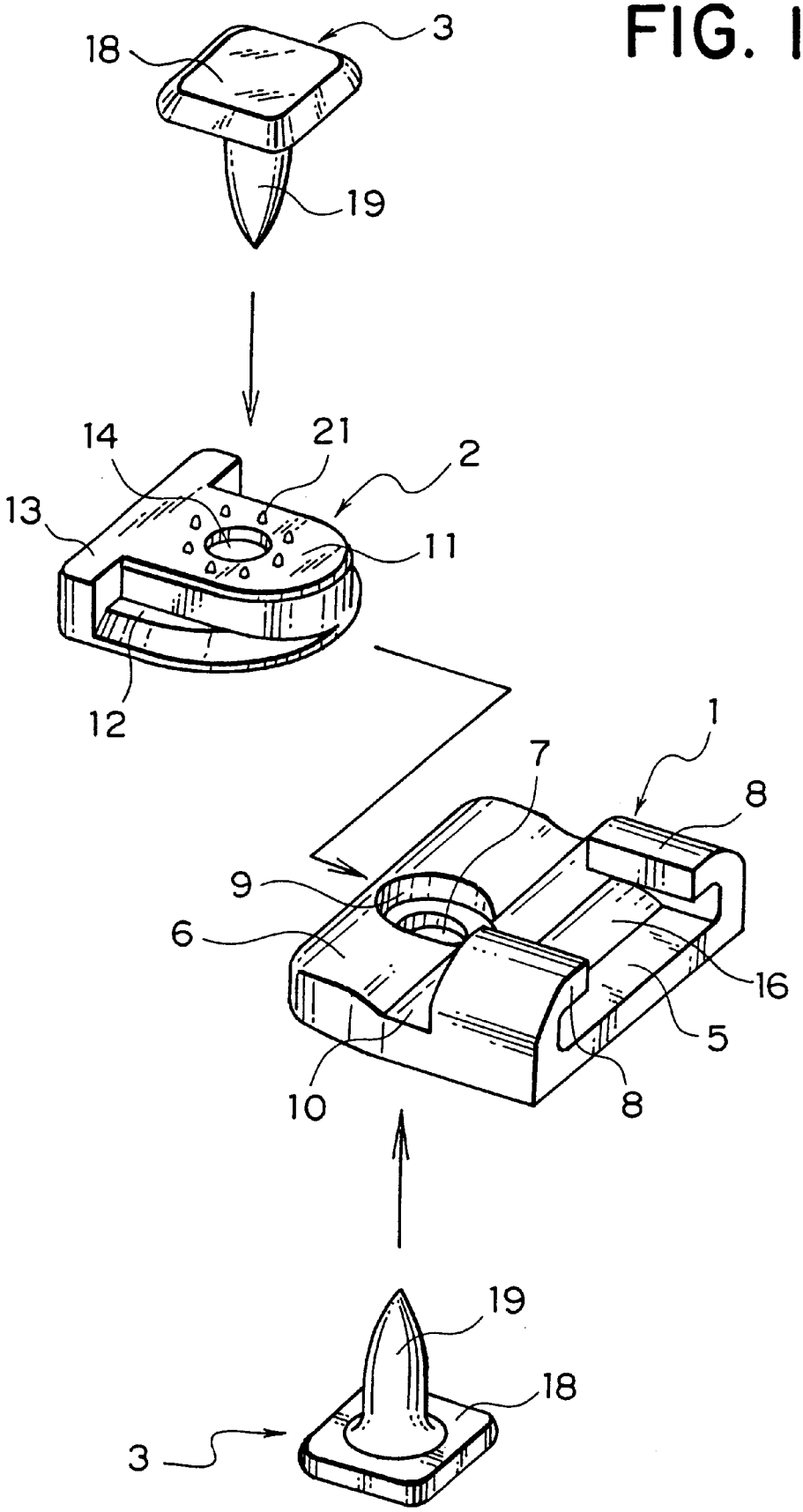
FIG. 14 is a taken-apart perspective view of a hook for clothes according to a second embodiment of the invention.

According to a first embodiment of the invention shown in FIG. 1 as well as a second embodiment of the invention shown in FIG. 14, the hook for clothes is comprised of a female member 1, a male member 2 and an attaching member 3. The female member 1 is attached onto cloth C with the attaching member 3 and the male member 2 is also attached onto cloth C with the attaching member 3. Then, the male member 2 is inserted into the female member 1 and engaged therewith. The female member 1, the male member 2 and the attaching member 3 are formed by injection molding or extrusion using thermoplastic resin such as polyacetal, polyamide, polypropylene, and polybutylene terphthalate.

Figure 2:
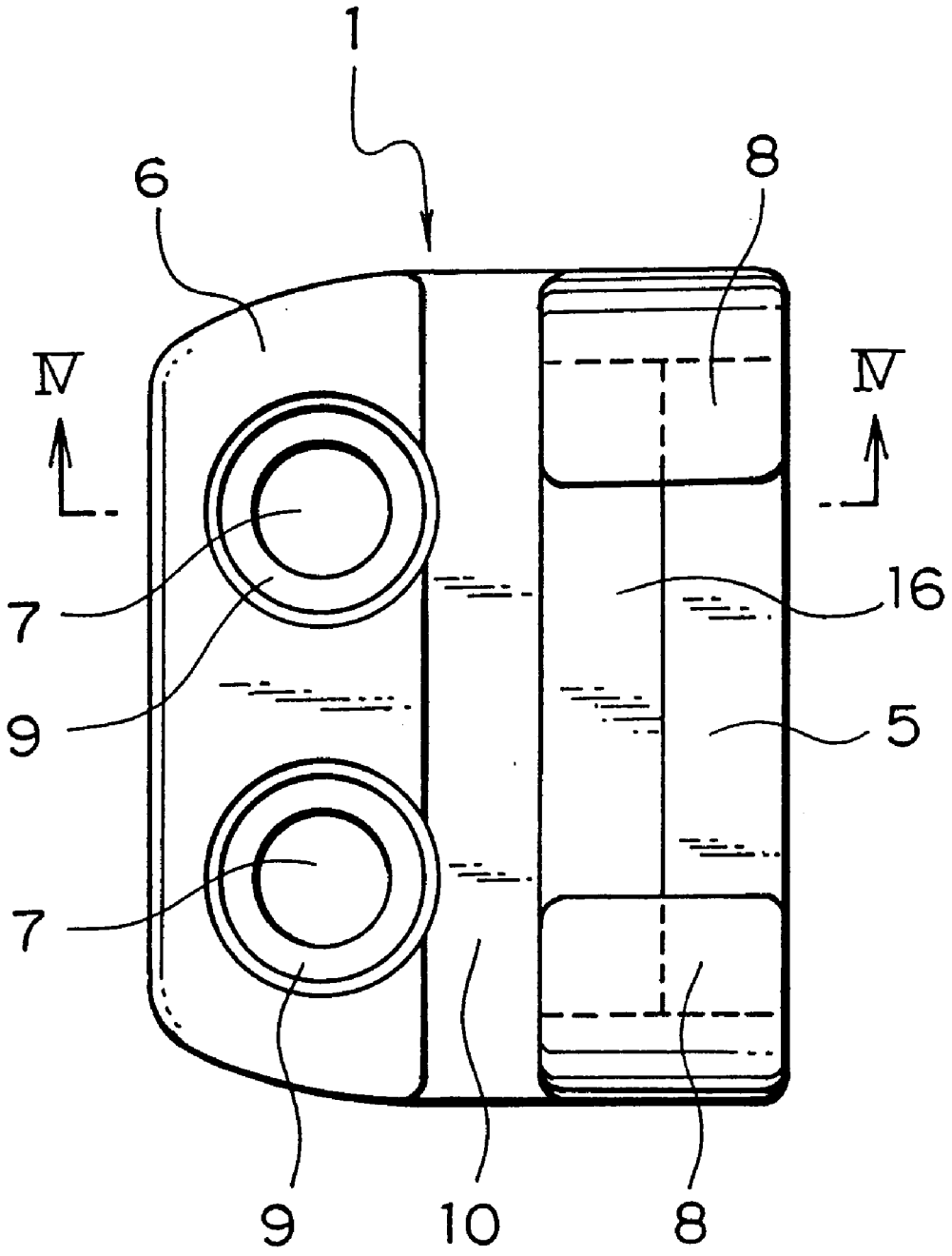
FIG. 2 is a front view of a female member of the hook of FIG. 1.
Figure 3:
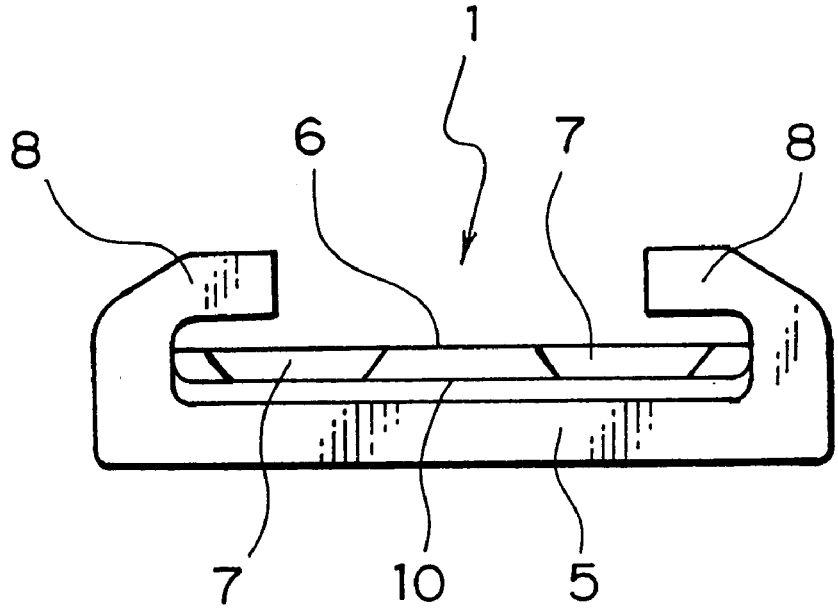
FIG. 3 is a side view of the female member of the hook of FIG. 1.
Figure 4:
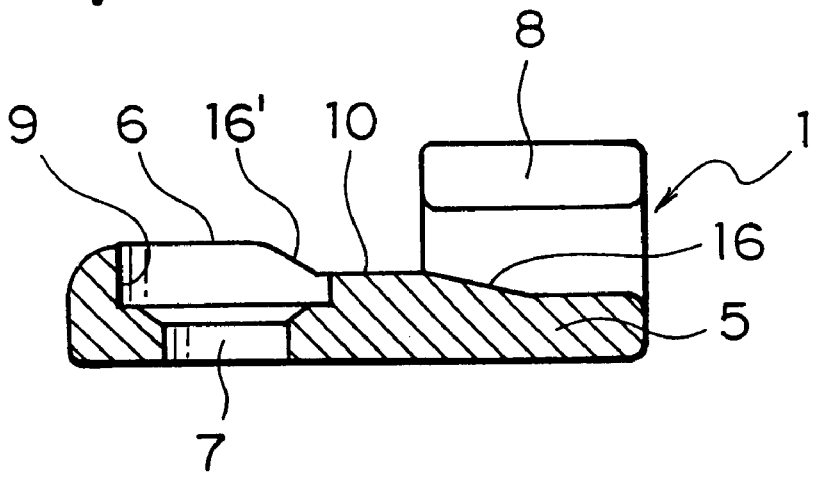
FIG. 4 is a sectional view taken along the line IV—IV in FIG. 2 of the female member of the hook of FIG. 1.

A hook for clothes according to the first embodiment will be described. In the female member 1, as shown in FIGS. 2 to 4, an upheaved portion 6 is formed at an end of a flat base plate 5 such that it is upheaved toward a front surface. Two attaching holes 7 each having a recess 9, in which its front surface side is expanded, and a T-shaped section are disposed in parallel in this upheaved portion 6 and then, by inserting attaching posts 19 of the attaching member 3 into these attaching holes 7, the female member 1 is attached onto cloth C. Hook-shaped engaging pieces 8 each having a predetermined width, so that the male member 2 can be inserted into and engaged with the engaging pieces 8, are provided on both sides of the base plate 5 near the upheaved portion 6 such that they opposes each other in inward direction. A horizontal flat portion 10 is provided between an inside end of the upheaved portion 6 and an inside end of each engaging pieces 8. This flat portion 10 is formed in a substantially the same size as an engaging protruded portion 13 of the male member and holds the engaging protruded portion 13 of the male member 2 so that the male member 2 is maintained horizontally.

A slope 16 is formed on a top face of the base plate 5, which is inclined gently from the flat portion 10 to a leading end of the base plate 5, so that the male member 2 can be inserted obliquely. Meanwhile, the slope 16 may have a gentle or steep difference of inclination and has only to be entirely inclined. Further, a part of the upheaved portion 6 being adjacent to the flat portion 10 is formed in the form of a slope 16', which is inclined toward the flat portion, so that the male member 2 can be inserted thereto more easily.

Figure 5:
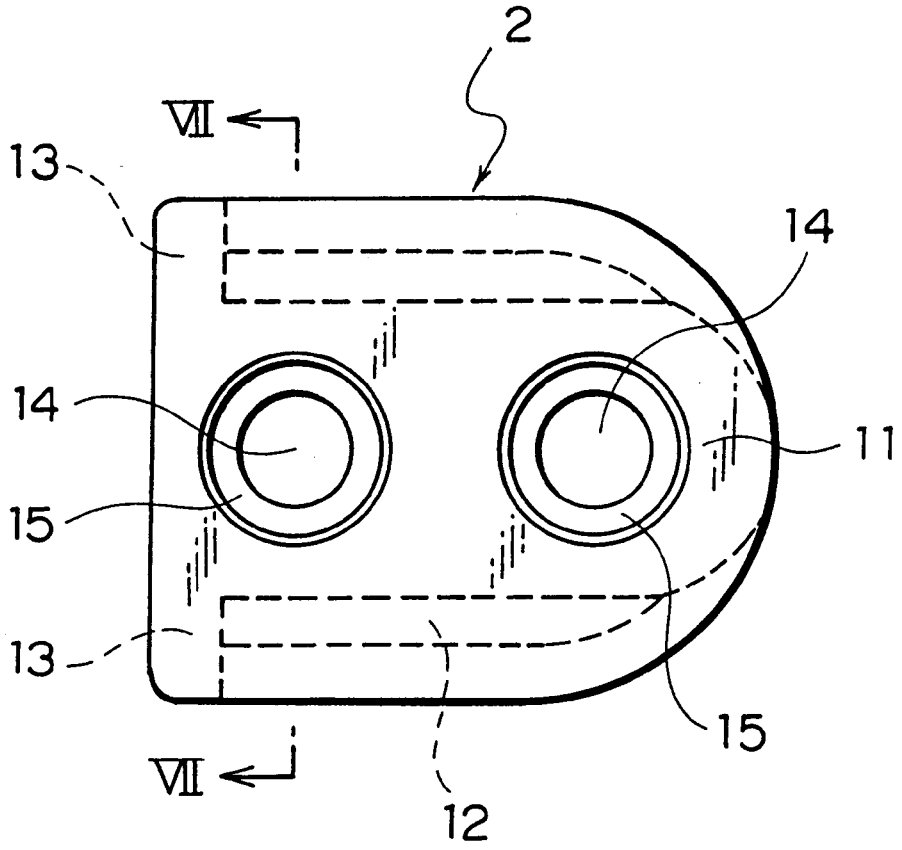
FIG. 5 is a front view of a male member of the hook of FIG. 1.
Figure 6:
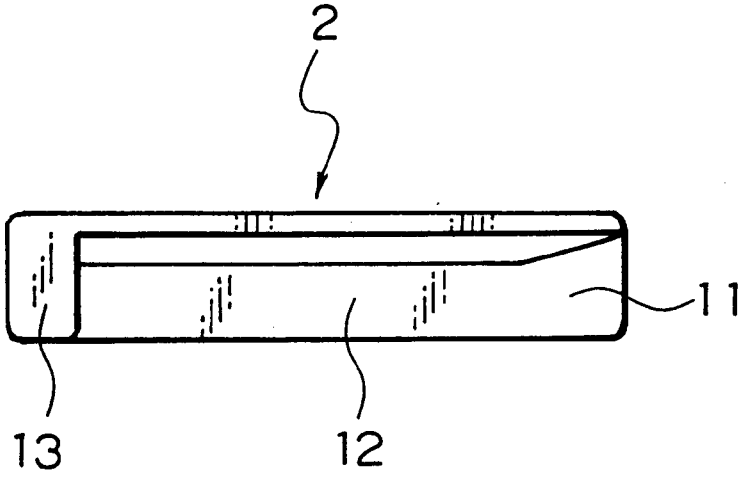
FIG. 6 is a bottom view of the male member of the hook of FIG. 1.
Figure 7:
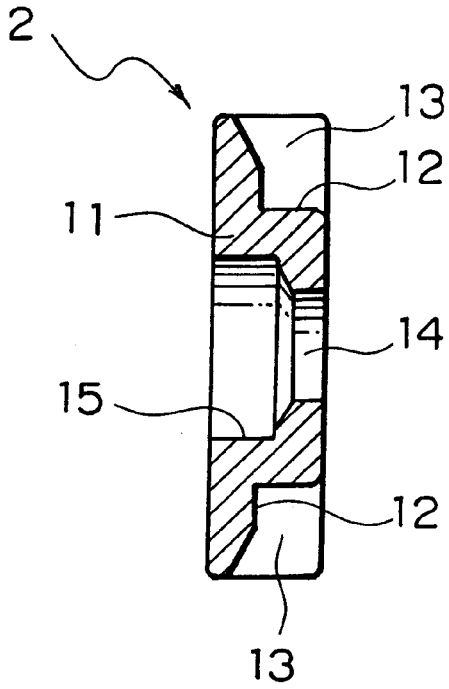
FIG. 7 is a sectional view taken along the line VII—VII in FIG. 5 of the male member of the hook of FIG. 1.

As shown in FIGS. 5 to 7, the male member 2 is slightly longer than the female member 1 and has a width such that the male member 2 can be inserted between the right and left engaging pieces 8. The male member 2 is formed of a base plate 11, which is substantially as thick as a protruding height of each engaging piece 8 and a front end of the base plate 11 is formed in the shape of arc. A concave portion 12 is formed on the attaching side to cloth C on each side of the base plate 11 by cutting out that portion while a distal end thereof is maintained. The concave portion 12 allows the engaging pieces 8 of the female member 1 to fix thereto with play and be formed slidably.

A rear end of the base plate 11 remaining at a distal end of the concave portion 12 is formed in the form of an engaging protruded portion 13, which is protruded laterally so as to come into contact with a side end face of the engaging pieces 8 of the female member 1 and is hooked by the engaging pieces 8 so as to stop the sliding of the male member 2. Two attaching holes 14 each having a recess 15 of substantially the same shape as the attaching hole 7 in the female member 1, in which its surface opposing the female member 1 is expanded, are disposed in parallel in a thick portion of the longitudinal direction in the center of the base plate 11. Then, attaching posts 19 of the attaching member 3 are inserted into this attaching holes 14 so as to attach the male member 2 to cloth C.

Figure 8:
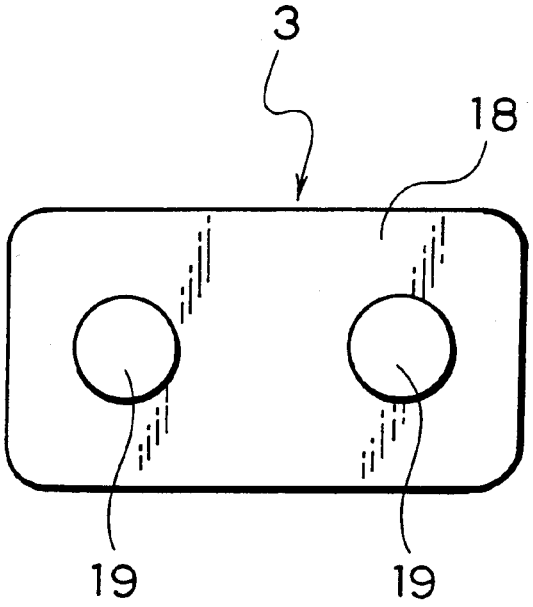
FIG. 8 is a front view of an attaching member of the hook of FIG. 1.
Figure 9:
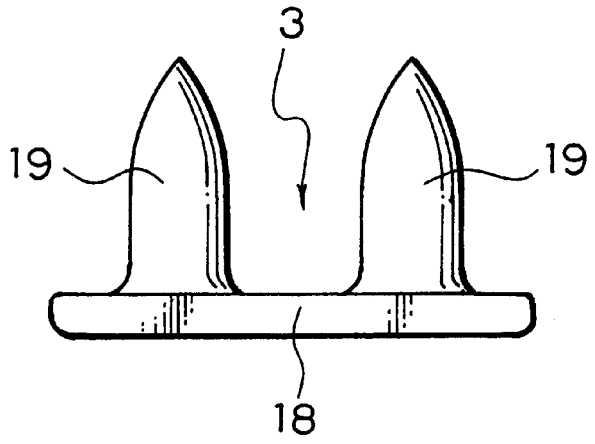
FIG. 9 is a bottom view of the attaching member of the hook of FIG. 1.

As shown in FIGS. 8 and 9, the attaching member 3 has the attaching posts 19 each having a pointed tip and a roundness coinciding with the attaching holes 7 in the female member 1 and attaching holes 14 in the male member 2 on a surface of a flat rectangular seat plate 18. The attaching posts 19 are spaced at an interval coinciding with an interval of the attaching holes 7 and 14. After piercing the cloth C, those attaching posts 19 are inserted into the attaching holes 7 and 14 and then, the tip thereof is crushed within each recess 9 and 15 of the attaching holes 7 and 14 and fixed therein.

Figure 10:
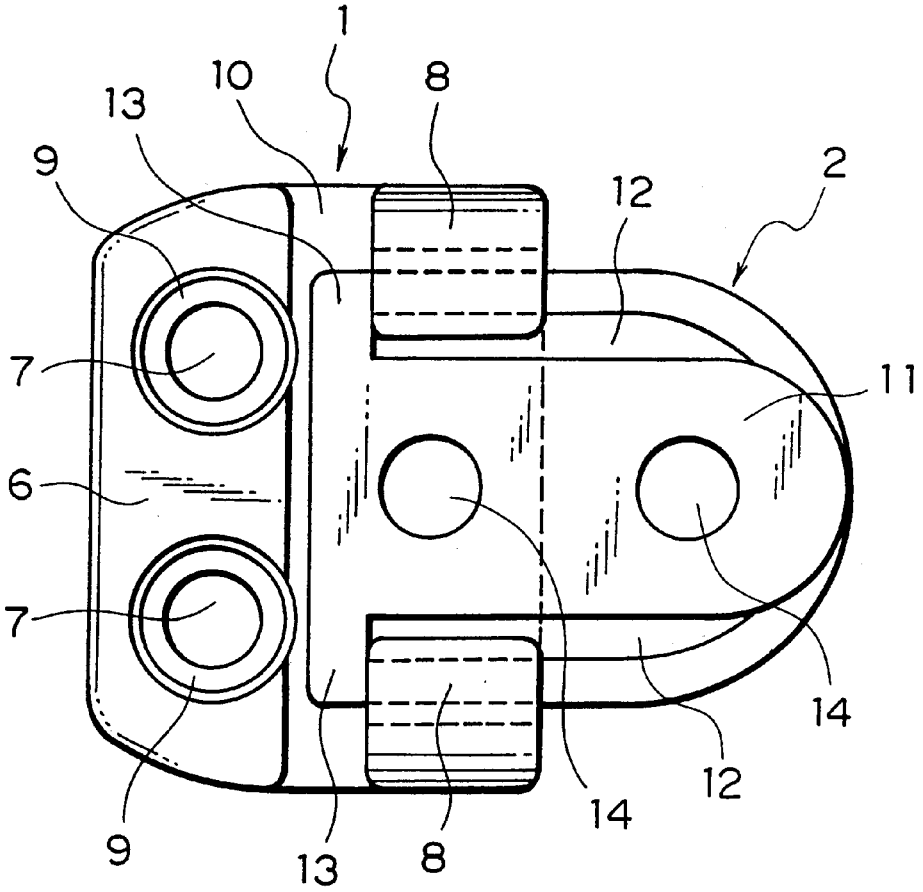
FIG. 10 is a front view showing a state in which the female member and the male member of the hook of FIG. 1 engage with each other.

As for relation of the female member 1 and the male member 2, as shown in FIG. 10, the concave portions 12 formed on both sides of the male member 2 are inserted into the hook-shaped engaging pieces 8 of the female member 1. Then, the engaging protruded portion 13 formed at the rear end of the concave portions 12 of the male member 2 is engaged with the engaging pieces 8 of the female member 1.

Figure 11:
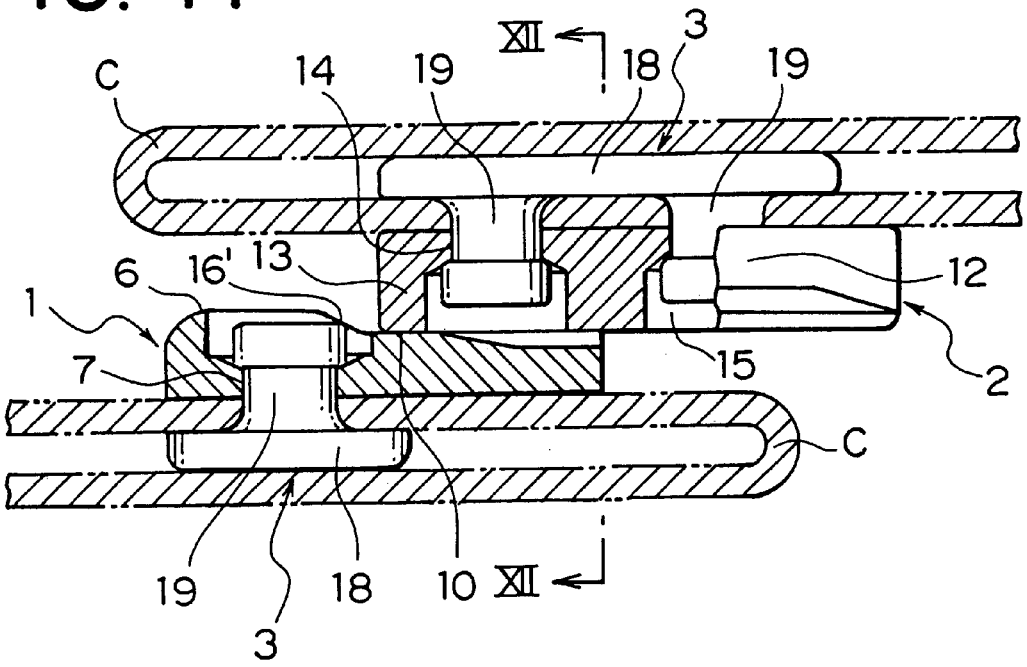
FIG. 11 is a partially cut sectional view showing a state in which the female member and the male member of the hook of FIG. 1 are attached onto cloth and both the members engage with each other.
Figure 12:
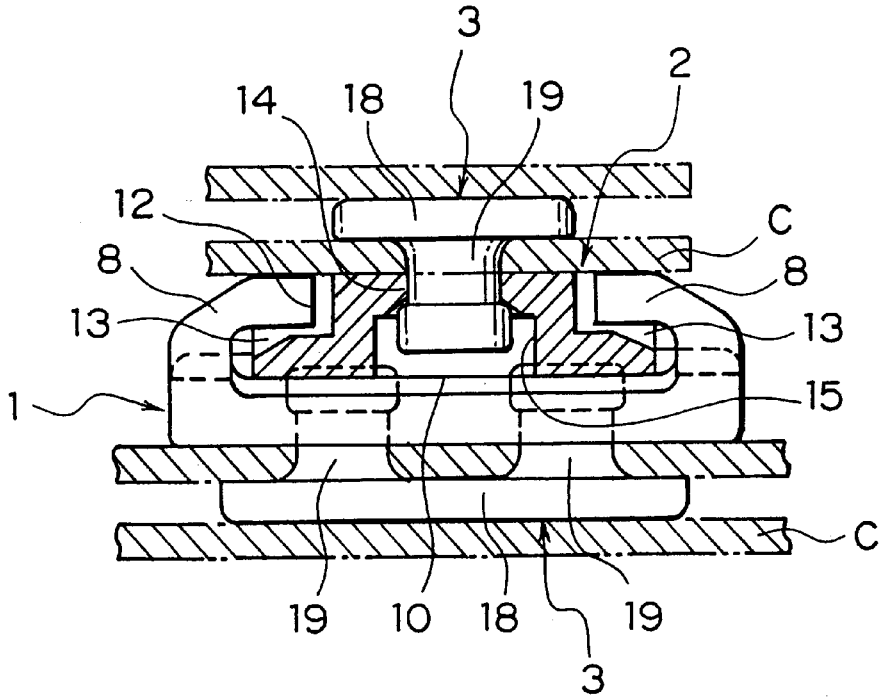
FIG. 12 is a sectional view taken along the line X II—X II in FIG. 11 showing a state in which the female member and the male member of the hook of FIG. 1 are attached onto cloth and both the members engage with each other.

When attaching the female member 1 or the male member 2 to cloth C, as shown in FIGS. 11 and 12, the attaching member 3 is disposed within cloth C, which is like the waist belt formed in the shape of tube, and the tips of the pointed attaching posts 19 of the attaching member 3 are thrust into cloth C. After the tips thereof are inserted into the attaching holes 7 provided in the female member 1, the tips are crushed within the recesses 9 of the attaching holes 7 by heating or cooling with pressure so as to fix the female member 1. For the male member 2 also, the attaching member 3 is disposed within the cloth C, which is like a waist belt formed in the shape of tube. After the tips of the attaching posts 19 of the attaching member 3 are thrust into the cloth C, the tips thereof are crushed within the recesses 15 of the attaching holes 14 in the male member 2 so as to fix the male member 2.

As described above, when attaching the female member 1 or the male member 2 onto the cloth C with the attaching member 3, the tips of the attaching posts 19 of the attaching member 3 are crushed within the recesses 9 and 15 of the attaching holes 7 and 14 exposed on the surface of the female member 1 or the male member 2 by heating or cooling with pressure. Therefore, the female member 1 and the male member 2 can be attached onto the cloth C easily and accurately by means of an automatic attaching apparatus.

When the male member 2 attached onto cloth C is inserted into the female member 1 attached onto another cloth C, as shown in FIG. 11, the engaging protruded portion 13 of the male member 2 is placed on the flat portion 10 formed on the female member 1 and held in an engagement state. When the female member 1 and the male member 2 are in the engagement state, even if the male member 2 tries to escape from the female member 1, the male member 2 cannot escape easily from the female member 1 because the engaging protruded portion 13 of the male member 2 keeps contact with the upheaved portion 6 of the female member 1.

Figure 13:
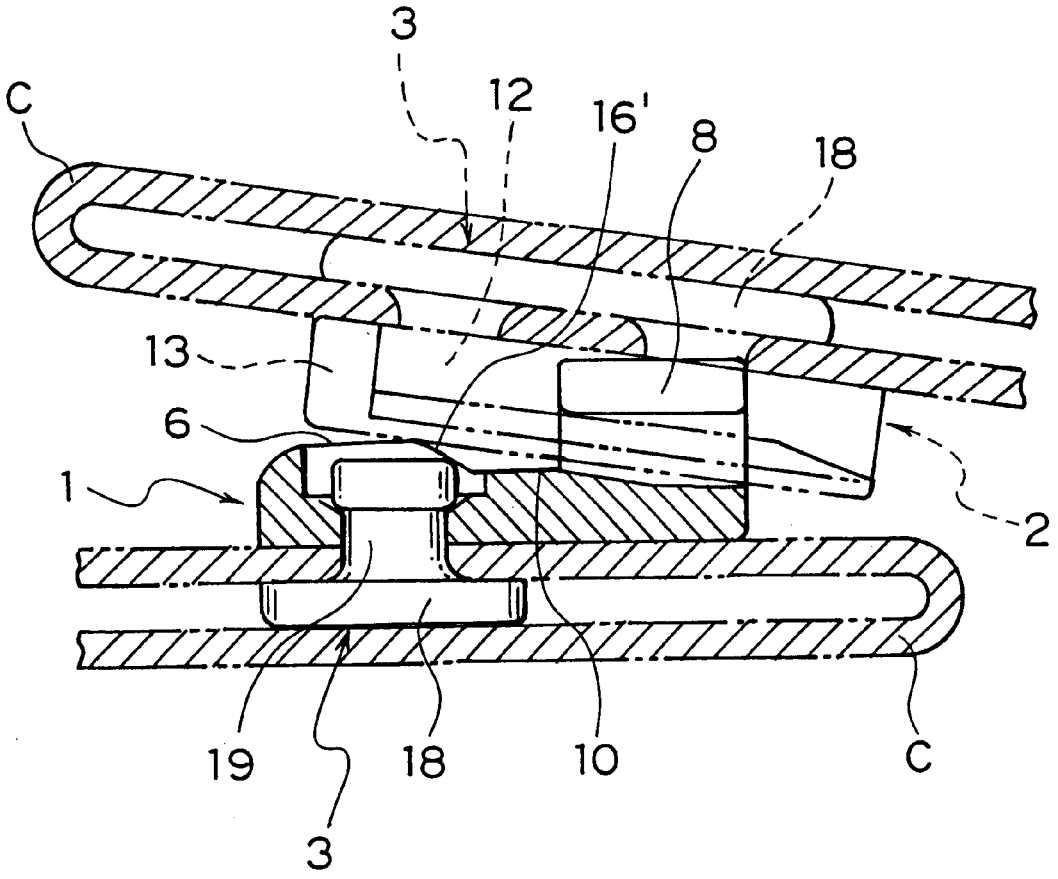
FIG. 13 is a sectional view showing an operation for insertion and release between the female member and the male member.

As for an operation for inserting the male member 2 into the female member 1, as shown in FIG. 13, the front end of the male member 2 is pushed along the engaging pieces 8 of the female member 1. Then, the male member 2 slides on the slope 16, 16' formed on the female member 1 and finally, the engaging protruded portion 13 comes into contact with the engaging pieces 8. At the same time, the male member 2 is maintained horizontally. If it is intended to release the male member 2 from the female member 1, the engaging protruded portion 13 of the male member 2 is brought up and then, the male member 2 is pulled out from the engaging pieces 8. Thus, the male member 2 is released from the female member 1 easily.

Figure 15:
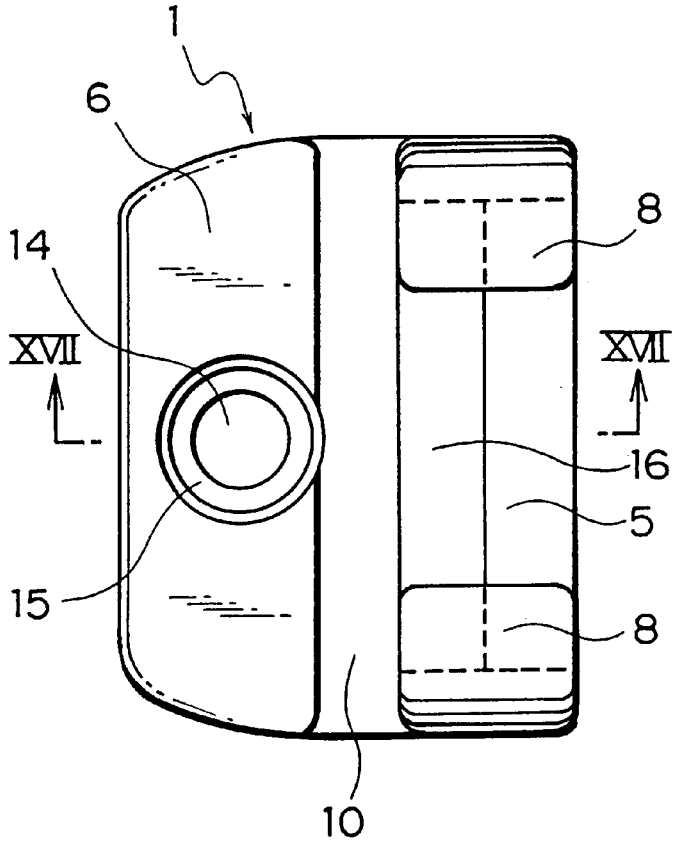
FIG. 15 is a front view of the female member of the hook of FIG. 14.
Figure 16:
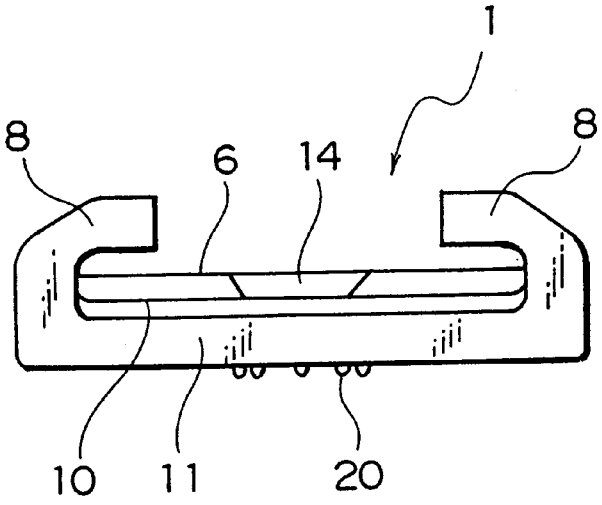
FIG. 16 is a side view of the female member of the hook of FIG. 14.
Figure 17:
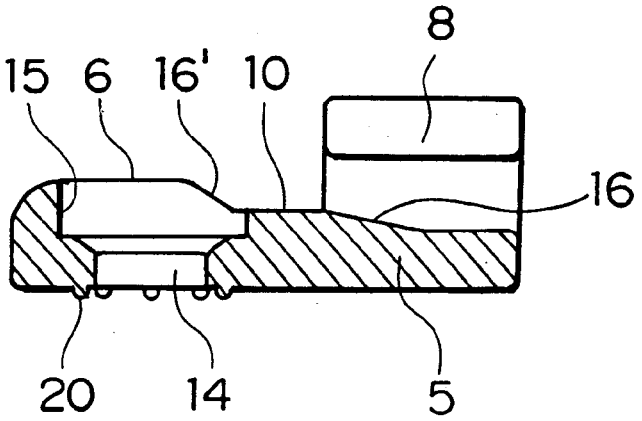
FIG. 17 is a sectional view taken along the line XVII—XVII in FIG. 15 of the female member of the hook of FIG. 14.

Next, a hook for clothes according to a second embodiment of the present invention will be described. As shown in FIG. 14, the hook for clothes is comprised of the female member 1, the male member 2 and the attaching member 3 like the first embodiment. As shown in FIGS. 15 to 17, the female member 1 has the upheaved portion 6, which is upheaved from a front surface thereof, provided at an end of the flat base plate 5. The attaching hole 7 having the recess 9 in which its front surface side is expanded is provided in the center of this upheaved portion 6. Plural small protrusions 20 are provided around the attaching hole 7 on the back face, that is, the opposite side so that they bite into cloth C. As a result, when the female member 1 is attached on cloth C, it can be attached in a stabilized state.

Then, the hook-shaped engaging pieces 8 having a predetermined width are provided on both sides of the base plate 5 near the upheaved portion 6 such that they oppose each other in inward direction. Additionally, the horizontal flat portion 10 is provided between inside end of the upheaved portion 6 and the inside end of each engaging piece 8. The engaging protruded portion 13 formed on the male member 2 is placed on the flat portion 10 so that the male member 2 is maintained horizontally. The slope 16, which is inclined from the flat portion 10 to a front end of the base plate 5, is formed on a top face of the base plate 5 and further, the slope 16', which is inclined from the upheaved portion 6 to the flat portion 10, is also formed. As a result, the male member 2 can be inserted obliquely.

Figure 18:
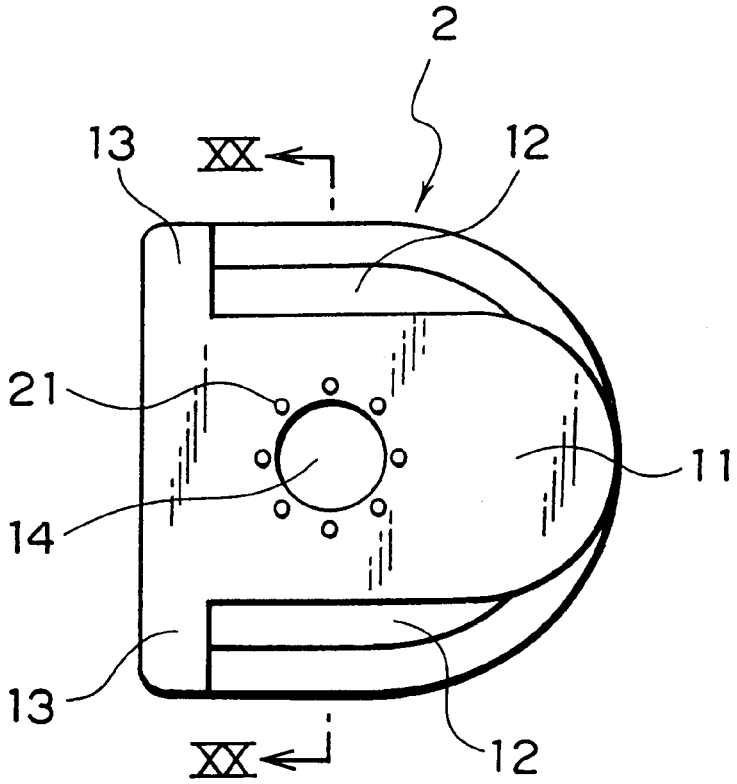
FIG. 18 is a front view of the male member of the hook of FIG. 14.
Figure 19:
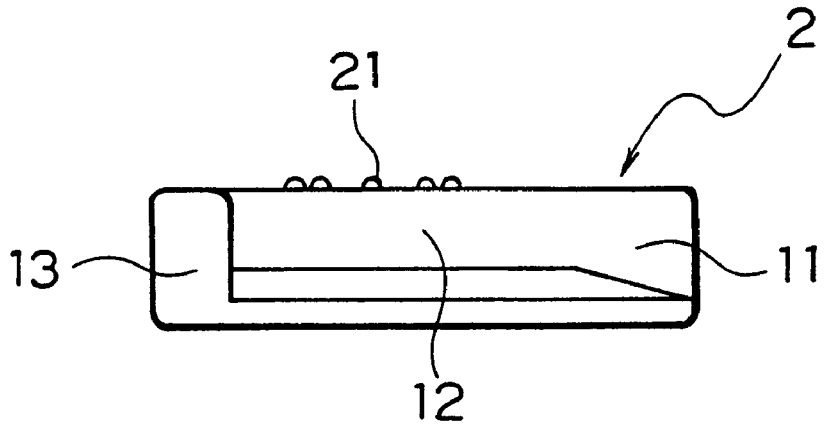
FIG. 19 is a bottom view of the male member of the hook of FIG. 14.
Figure 20:
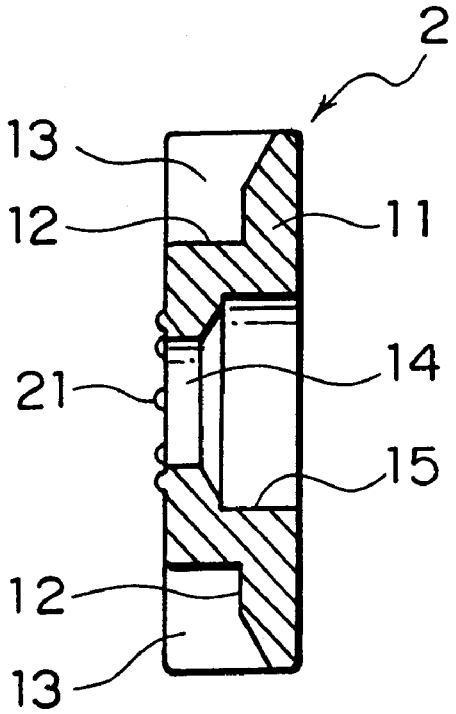
FIG. 20 is a sectional view taken along the line XX—XX in FIG. 18 of the male member of the hook of FIG. 14.

As shown in FIGS. 18 to 20, the male member 2 is formed of the base plate 11, which is substantially as long as the female member 1, as wide as can be inserted between the right and left engaging pieces 8 and substantially as high as a protruding height of the engaging piece 8. A front end of the base plate 11 is formed in the shape of arc and the concave portion 12 is formed on each of side faces by cutting out a back face thereof, such that the engaging pieces 8 of the female member 1 can fix the concave portion 12 with play.

The engaging protruded portion 13 is formed at a rear end of the concave portion 12 such that it is projected laterally, so as to make contact with the side end faces of the engaging pieces 8 of the female member 1. Thus, the engaging protruded portion 13 has a function of stopping sliding of the male member 2 by contacting with the engaging pieces 8. The attaching hole 14 having the recess 15 of the same shape as the attaching hole 7 in the female member 1 is provided in a thick portion in the center of the base plate 11, so that the attaching post 19 of the attaching member 3 can be inserted into the attaching hole 14. Plural small protrusions 21, which bite into cloth C, are provided around the attaching hole 14 on the back face. As a result, when the male member 2 is attached onto cloth C, the male member 2 is fixed in a stabilized state.

Figure 21:
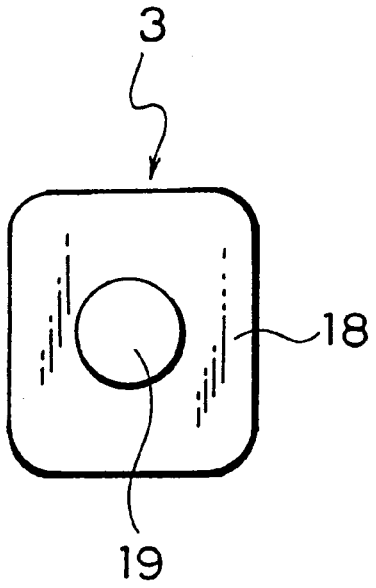
FIG. 21 is a front view of an attaching member of the hook of FIG. 14.
Figure 22:
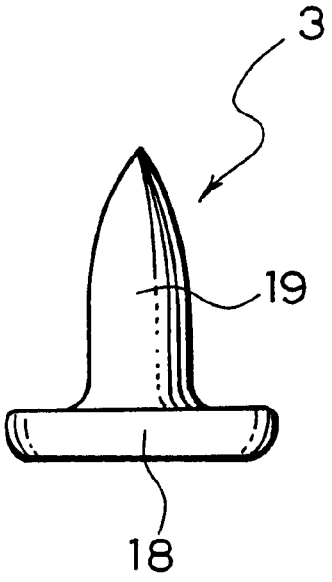
FIG. 22 is a bottom view of the attaching member of the hook of FIG. 14.

In the attaching member 3, an attaching post 19 having a pointed tip is posted in the center of a square flat seat plate 18 as shown in FIGS. 21 and 22 and this attaching post 19 has a roundness coinciding with the attaching hole 7 in the female member 1 and attaching hole 14 in the male member 2. After piercing the cloth C, the tip of the attaching post 19 is inserted into each of the attaching holes 7 and 14 and crushed within each of the recesses 9 and 15. Meanwhile the seat plate 18 may be circular and it is also permissible to provide with plural small protrusions which bite into cloth C around a base portion of the attaching post 19 on the seat plate 18 so as to keep the seat plate 18 in a stabilized state.

Figure 23:
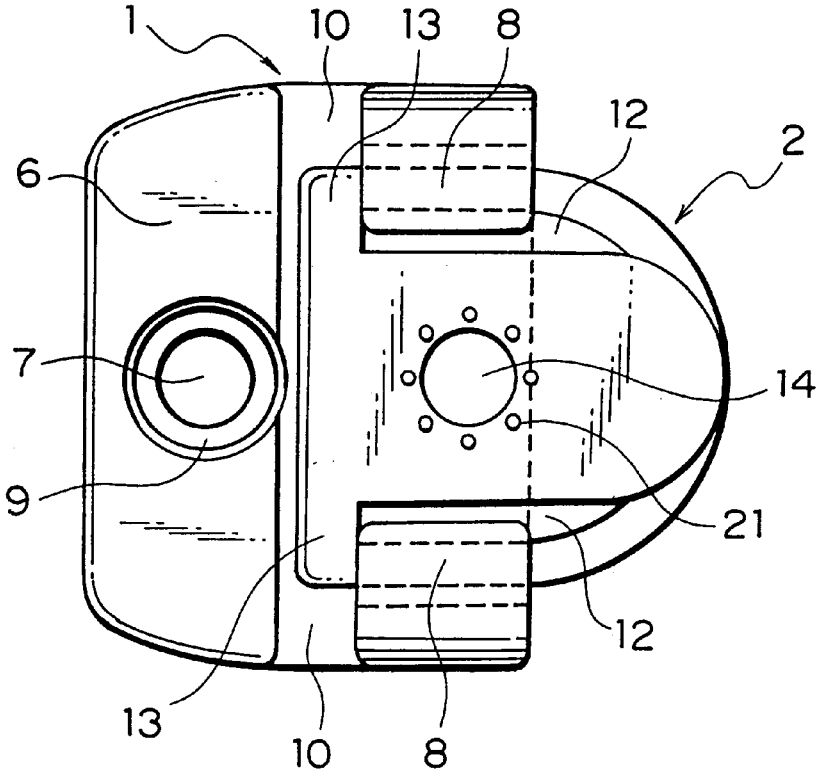
FIG. 23 is a front view showing a state in which the female member and the male member of the hook of FIG. 14 engage with each other.

As for relation between the female member 1 and the male member 2, as shown in FIG. 23, the concave portions 12 formed on both sides of the base plate 11 of the male member 2 are inserted into the hook-shaped engaging pieces 8 formed on both sides of the base plate 5 of the female member 1 like the previous case. The engaging protruded portion 13 formed at the end of the concave portion 12 of the male member 2 is brought into contact with the engaging pieces 8 of the female member 1, so that the male member 2 is engaged there.

Figure 24:
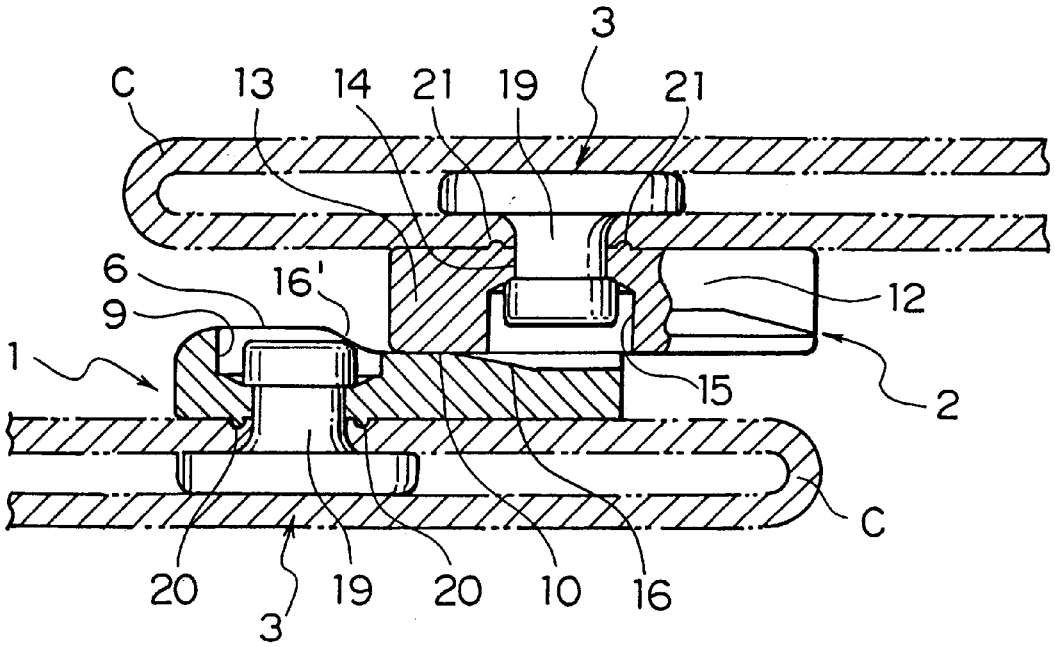
FIG. 24 is a partially cut sectional view showing a state in which the female member and the male member of the hook of FIG. 14 are attached onto cloth and both the members engage with each other.
Figure 25:
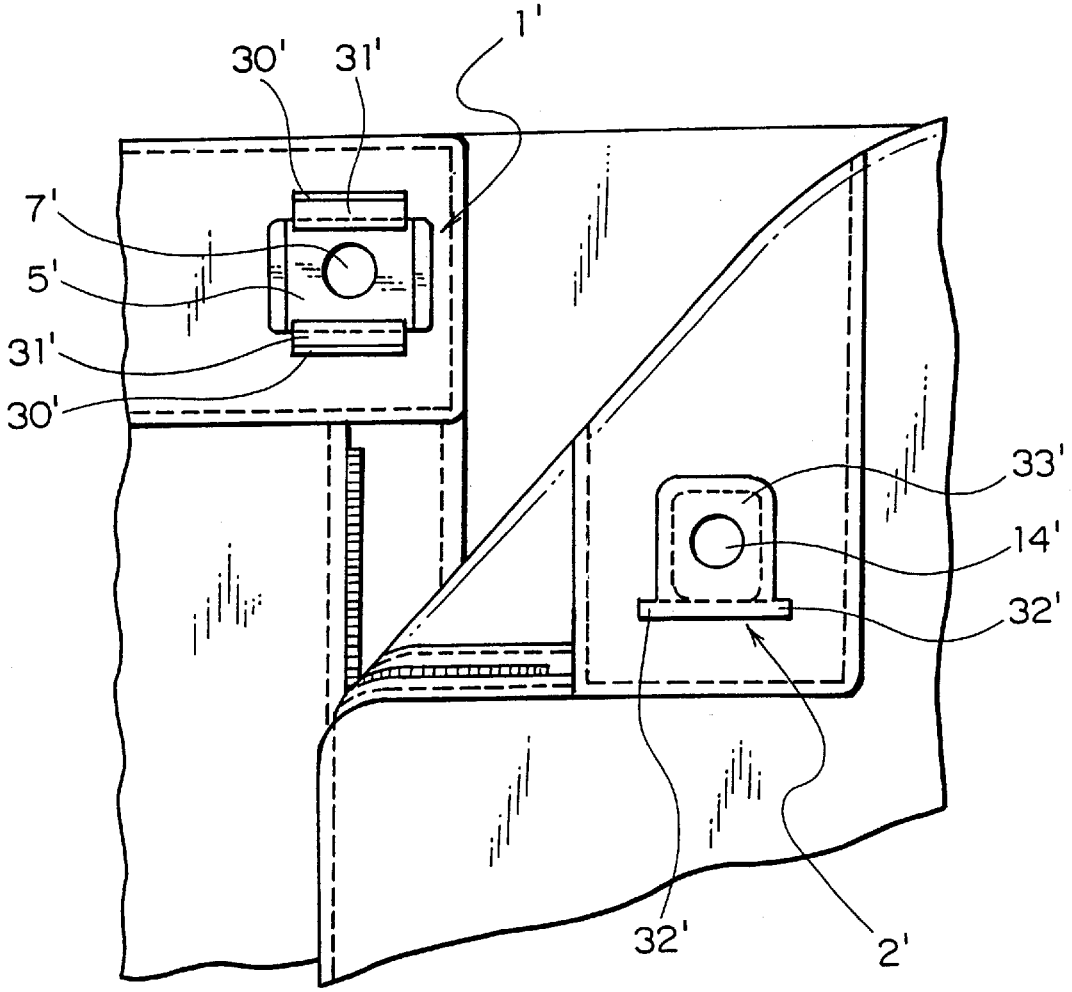
FIG. 25 is a front view showing a use state of a well known hook for clothes.
Figure 26:
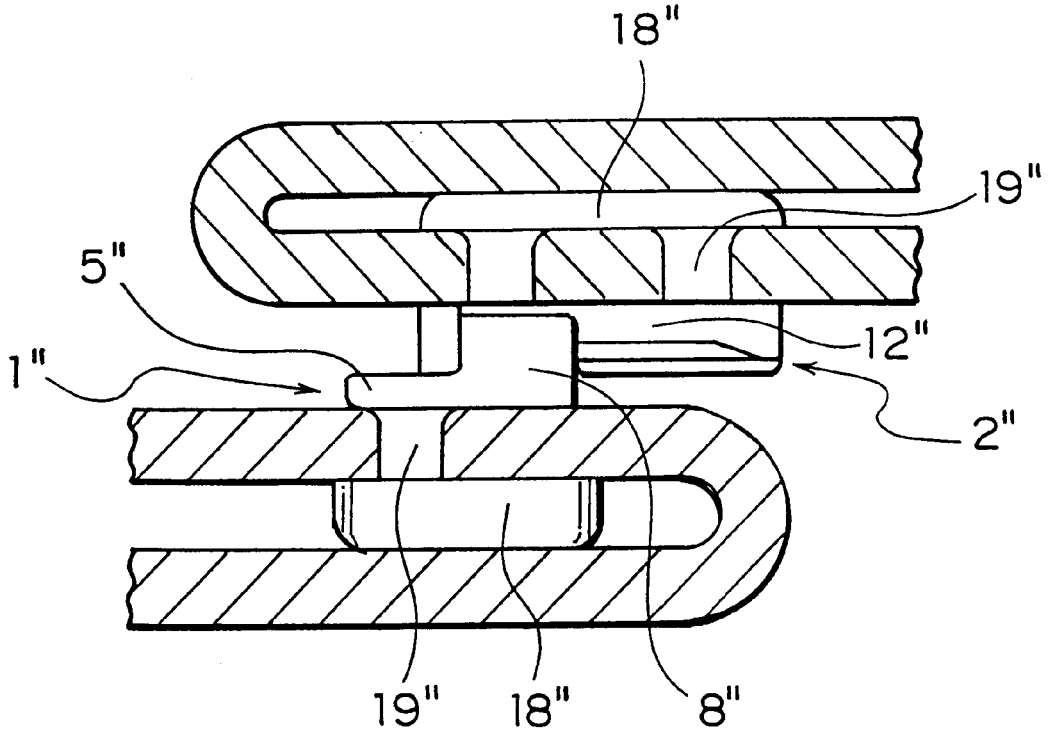
FIG. 26 is a sectional view showing an engagement state between the female member and the male member of another well known hook for clothes.

When attaching each of the female member 1 and the male member 2 onto cloth C, as shown in FIG. 24, the attaching member 3 is disposed within the waist belt formed in the shape of tube and the tip of the pointed attaching post 19 is thrust into cloth C so that it is exposed on the surface of cloth C. Then, the tip is inserted into the attaching hole 7 in the female member 1 from its back side, so that the plural small protrusions 20 on the back face of the base plate 5 are made to oppose cloth C. By crushing the tip of the attaching post 19 within the recess 9 of the attaching hole 7 by heating or cooling with pressure, the female member 1 is attached onto cloth C. For the male member 2 also, the attaching member 3 is also disposed within the waist belt formed in the shape of tube and the tip of the attaching post 19 is thrust into cloth C. After that, the tip of the attaching post 19 is inserted into the attaching hole 14 provided in the male member 2 from its back side, so that the plural small protrusions 21 provided on the back face of the base plate 11 are made to oppose cloth C. By crushing the tip of the attaching post 19 within the recess 15 of the attaching hole 14, the male member 2 is attached onto cloth C.

The attaching post 19 is posted on the seat plate 18 of the attaching member 3. In the female member 1 and the male member 2, the small protrusions 20 and 21 provided on the back faces of the base plates 5 and 11 bite into cloth C thereby securely preventing the female member 1 and the male member 2 from rotating around the attaching post 19.

When the male member 2 attached onto cloth C is inserted into the female member 1 attached onto another cloth C, the engaging protruded portion 13 of the male member 2 is placed on the flat portion 10 formed on the female member 1 and held in an engagement state. Because the engaging protruded portion 13 of the male member 2 keeps contact with the upheaved portion 6 of the female member 1 in the engagement state, the male member 2 is prevented from escaping from the female member 1 easily. Meanwhile, the operation for insertion is the same as the previous example.

The hook for clothes of the invention has the above described structure. With this structure, the following effects are achieved.

According to the invention, the female member 1 has a upheaved portion 6 at an end of its base plate 5, attaching holes 7 are provided in the upheaved portion and hook-shaped engaging pieces 8 are provided on both sides of the base plate 5 such that they oppose each other in inward direction. Consequently, with using the upheaved portion 6 formed at the end of the flat base plate 5, the female member 1 can be attached onto cloth C of clothes firmly and easily. Further, an existence of the upheaved portion 6 prevents the male member from escaping easily.

The male member 2 has a concave portion 12 on each side face of its base plate 11 allowing the engaging pieces 8 to fix with play, an engaging protruded portion 13 provided laterally at a rear end of the concave portion 12 and attaching holes 14 are provided in the base plate 11. Consequently, the male member 2 can engage with the female member 1 accurately and can be attached onto cloth C in a stabilized state.

The attaching member 3 has attaching posts 19 capable of being inserted into the attaching holes 7, 14 of the female member 1 and the male member 2, provided on a face of its flat seat plate 18 such that they are posted. Consequently, the attaching member 3 can be used for both the female member 1 and the male member 2 in common. Further, the attaching member 3 can attach the female member 1 and the male member 2 to cloth C with a good appearance.

And two attaching holes 7 each having a recess 9, in which its front surface side is expanded, are disposed laterally in the upheaved portion 6 of the female member 1.

Consequently, the female member 1 can be attached onto cloth C easily by means of an automatic machine and in a stabilized state with a good appearance.

Further, one attaching hole 7 having a recess 9, in which its front side is expanded, is disposed in the center of the upheaved portion 6 of the female member 1 with plural small protrusions 20 being disposed around the attaching hole 7 on a back face. Consequently, the female member 1 can be attached easily by means of an automatic machine, and with only a single attaching hole 7, the female member 1 can be prevented from rotating and can be attached onto cloth C in a stabilized state. Further, this structure is suitable for a small female member 1.

And further, a horizontal flat portion 10 is formed between ends of the engaging pieces 8 and an end of the upheaved portion 6, disposed on the base plate 5 of the female member 1, such that the engaging protruded portion 13 of the male member 2 is capable of being placed thereon horizontally. As a result, the female member 1 is capable of maintaining the male member 2 in a stabilized state.

Further, a slope 16 is formed on the base plate 5 of the female member 1 such that it is entirely inclined gently from the flat portion 10 to a leading end of the base plate 5. Consequently, the male member 2 can be inserted obliquely from above smoothly into the female member 1 attached onto cloth C of clothes and can be operated with room and effectively for insertion.

Still further, two attaching holes 14 each having a recess 15, in which a face thereof opposing the female member 1 is expanded, are disposed along the center line of the base plate 11 of the male member 2. Consequently, the male member 2 can be attached easily by means of an automatic machine and can be attached onto cloth C in a stabilized state with a good appearance.

And further, one attaching hole 14 having a recess 15, in which a face thereof opposing the female member 1 is expanded, is disposed in the center of the base plate 11 of the male member 2 with plural small protrusions 21 being provided around the attaching hole 14 on a back face of the base plate 11. Consequently, the male member 2 can be attached easily by means of an automatic machine, and with only a single attaching hole 14, the male member 2 can be prevented from rotating and can be attached onto cloth C in a stabilized state. Further, this structure is suitable for a small male member 2. As described above, the advantages which the present invention achieves are very remarkable.

What is claimed is:

1. A hook for clothes, comprising: a female member, a male members and attaching members, wherein said female members has an upheaved portion at an end of its base plate; attaching holes in said upheaved portion; hook-shaped engaging pieces on both sides of the base plate such that they oppose each other in inward direction; said male member has a concave portion on a side face of its base plate allowing said engaging pieces to fix with play; an engaging protruded portion provided laterally at a rear end of said concave portion; attaching holes in said base plate of said male member; said attaching members has attaching posts capable of being inserted into each of said attaching holes of said female and male members, provided on a face of its flat seat plate.

2. A hook for clothes according to claim 1, wherein two attaching holes each having a recess, in which its front surface side is expanded, are disposed laterally in the upheaved portion of said female member.

3. A hook for clothes according to claim 1, wherein one attaching hole having a recess, in which its front side is expanded, is disposed in the center of the upheaved portion of said female member while plural small protrusions are disposed around said attaching hole on a back face of said base plate of said female member.

4. A hook for clothes according to claim 1, wherein a horizontal flat portion is formed between ends of the engaging pieces and a base portion of the upheaved portion, disposed on the base plate of said female member so that said male member is capable of being placed horizontally.

5. A hook for clothes according to claim 1, wherein a slope is formed on the base plate of said female member such that it is entirely inclined gently from a flat portion to a leading end of the base plate of said female member.

6. A hook for clothes according to claim 1, wherein two attaching holes each having a recess, in which a face thereof opposing said female member is expanded, are disposed along the center line of the base plate of said male member.

7. A hook for clothes according to claim 1, wherein one attaching hole having a recess, in which a face thereof opposing said female member is expanded, is disposed in the center of the base plate of said male member while plural small protrusions are provided around said attaching hole on a back face of said base plate of said female member.

* * * * *